United States Patent [19]

Mertler

[11] 3,964,004

[45] June 15, 1976

[54] THERMOSTATIC SWITCH WITH STANDBY CONTACTS

[76] Inventor: Charles S. Mertler, 1012 Briarwood Road, Mansfield, Ohio 44907

[22] Filed: June 19, 1975

[21] Appl. No.: 588,496

Related U.S. Application Data

[63] Continuation-in-part of Ser. No. 445,778, Feb. 25, 1974, Pat. No. 3,913,048.

[52] U.S. Cl. ..... 337/67; 200/DIG. 42; 337/85; 337/337; 337/355

[51] Int. Cl.[2] ..... H01H 71/16

[58] Field of Search ..... 200/67 PK, DIG. 42; 335/89, 90; 337/67, 68, 85, 355, 360, 361, 347, 362, 374, 337

[56] References Cited

UNITED STATES PATENTS

| | | | |
|---|---|---|---|
| 3,201,548 | 8/1965 | Mertler | 337/355 |
| 3,236,977 | 2/1966 | Huffman | 337/355 X |
| 3,452,312 | 6/1969 | Bauer | 337/355 X |
| 3,609,261 | 9/1971 | Rys | 200/DIG. 42 |
| 3,617,665 | 11/1971 | Mook et al. | 200/DIG. 42 |
| 3,913,048 | 10/1975 | Mertler | 337/67 |

*Primary Examiner*—J. D. Miller
*Assistant Examiner*—Fred E. Bell
*Attorney, Agent, or Firm*—Woodling, Krost, Granger & Rust

[57] ABSTRACT

A combined thermostatic switch and tilt switch is disclosed which is of the stack type with slow make and break contacts. A temperature responsive element such as a bimetal actuates a set of contacts and an attitude responsive means such as a swingable pendulum also actuates a set of contacts. These two responsive means may actuate the same set of contacts or may actuate different sets of contacts in various embodiments of the invention, but a second set of contacts is provided in the switch as a standby set of contacts which may be actuated by one of the responsive means in the event that the first set of contacts fails to be actuated, e.g. by being welded together or some other malfunction. The foregoing abstract is merely a resume of one general application, is not a complete discussion of all principles of operation or applications, and is not to be construed as a limitation on the scope of the claimed subject matter.

31 Claims, 12 Drawing Figures

THERMOSTATIC SWITCH WITH STANDBY CONTACTS

This application is a continuation-in-part of my application Ser. No. 445,778, filed Feb. 25, 1974 now U.S. Pat. No. 3,913,048.

BACKGROUND OF THE INVENTION

My prior U.S. Pat. No. 3,201,548, issued Aug. 17, 1965, showed a standard commercial construction of a thermostatic switch and a tilt-responsive switch. This attitude responsive switch was dependent upon the position of a swinging pendulum mounted on a resilient contact blade. The movement of the pendulum or the movement of a temperature responsive means, namely, a bimetal, could actuate one set of contacts. Such combined thermostat and attitude responsive switch was useful in devices such as electric room heaters wherein it was desired to control the temperature of the air warmed by the heater and yet the room heater might be tipped over which could be a fire hazard, hence, the attitude responsive switch would disconnect the electrical circuit to make a safe appliance.

It has been found that under long use the contacts actuated by the temperature responsive means might malfunction. For example, this might be that the contacts would weld together due to the creep action initiated by the bimetal. The homeowner might not be aware that the contacts had welded closed and might continue to use the room heater even though the thermostat was no longer functional. Under such a condition the attitude responsive pendulum also would not be functional because if the room heater were tipped over and the pendulum tried to actuate the contacts, the welding together thereof meant that the circuit could not be opened.

In other prior art patented systems flat irons have been controlled with both a temperature responsive means and a tilt responsive means so that when the flat iron was rested on its heel, the tilt responsive means controlled the contacts. Some of these designs had two contacts in series with one actuated by the temperature responsive means and the other actuated by the tilt responsive means, or else both actuated by both responsive means, yet in no case was one set of contacts actuated by one responsive means and actuable by the other responsive means as a standby set of contacts.

Electric room heaters have also had switches which are controlled by temperature responsive means and by a means responsive to the tilting of the entire electric heater, namely, a plunger which can contact the floor. In one such patented construction two separate contacts were provided, one for the plunger and one for the bimetal; but these contacts were on opposite sides of the stack which mounted all of the flexible blades. In another construction two flexible blades were on opposite sides of a rigid blade, with all three blades carrying contacts and with a plunger actuating one flexible blade and a bimetal actuating the other flexible blade; but in no case was there any standby actuation of an additional set of contacts.

SUMMARY OF THE INVENTION

The invention may be incorporated in a thermostatic switch comprising, in combination, a base, at least first, second, and third contacts, said first and second contacts constituting a first set of contacts, said third contact and another contact constituting a second set of contacts, first and second electrical terminals, conductive means forming a series electrical circuit from said first terminal through said first and second sets of contacts to second terminal, temperature responsive means movable with changes of attitute relative to said switch, first mounting means mounting on said switch one of said responsive means relative to the contact sets to relatively actuate the contacts of one of said sets of contacts, and second mounting means mounting on said switch the other of said responsive means relative to the contact sets to relatively actuate the contacts of said first contact set to an open condition and to relatively actuate on a standby basis the contacts of said second contact set in a direction toward an open condition upon failure of said first contact set to be actuated to an open condition.

An object of the invention is to provide a switch which may be actuated both by a temperature responsive means and by an attitude responsive means and which has standby contacts in case of failure of actuation of a first set of contacts.

Another object of the invention is to provide first and second sets of contacts connected in series circuit in a switch with temperature responsive means actuating one set of contacts and attitude responsive means actuating one of the sets of contacts and with one of the responsive means also being capable of actuating the other set of contacts on a standby basis.

Another object of the invention is to provide a switch with at least three contacts grouped into two contact sets and with temperature responsive means as well as attitude responsive means, each of these responsive means being capable of actuating a set of contacts and with two adjacent ones of the contacts being movable.

Other objects and a fuller understanding of the invention may be had by referring to the following description and claims, taken in conjunction with the accompanying drawing.

DESCRIPTION OF THE PREFERRED EMBODIMENT

Figure 1:
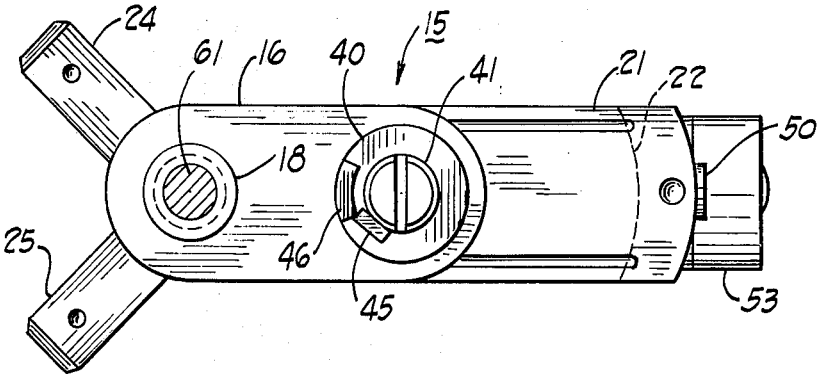
FIG. 1 is a plan view of a thermostatic switch incorporating the invention and also having an attitude responsive pendulum.
Figure 2:
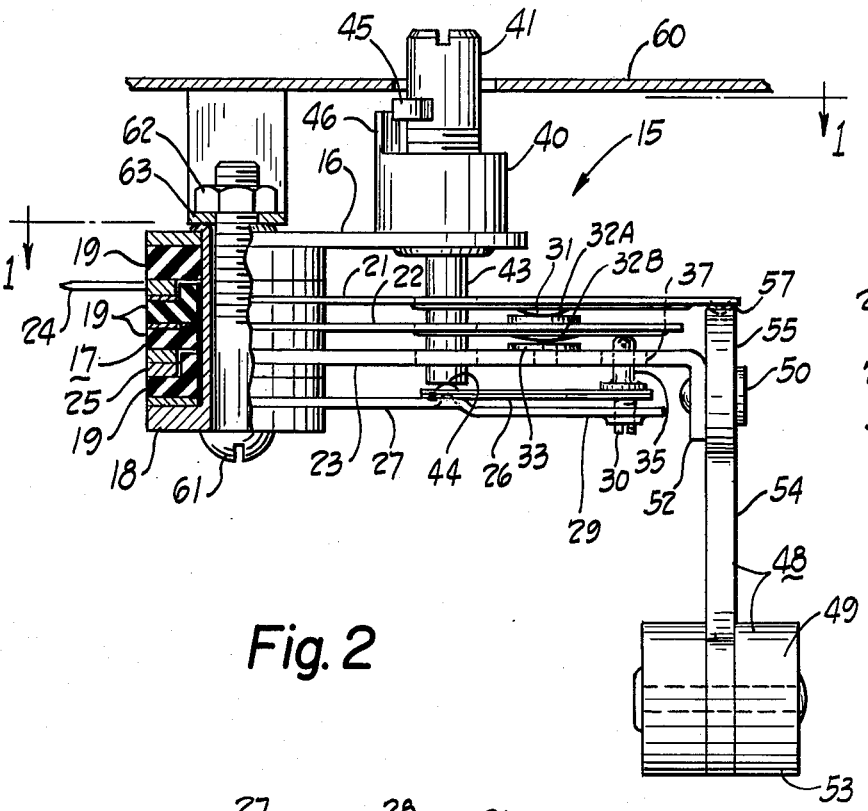
FIG. 2 is a side elevational view of the switch of FIG. 1.
Figure 3:
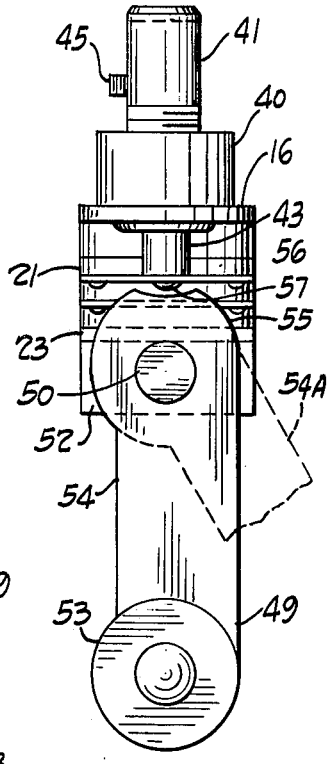
FIG. 3 is an end elevational view of the switch of FIG. 2.

FIGS. 1–3 show a preferred embodiment of a thermostatic switch 15 which is also attitude responsive. The switch 15 includes a base 16 and a stack 17 mounted on the base. The stack 17 is mounted to the base by a hollow rivet 18. The stack 17 fastens together various parts of the thermostatic switch 15 and includes insulating washers 19 to insulate electrically live portions of the switch from the base 16.

The stack 17 mounts first and second flexible blades or blade means 21 and 22 and mounts third blades means 23 which is relatively rigid. Terminals 24 and 25 are mounted in the stack 17 in electrical and physical contact with the first and third blades 21 and 23, respectively.

The stack 17 also carries temperature responsive means shown as a bimetallic blade 26. The term bimetallic also includes the term trimetallic, so long as the blade 26 moves in response to changes of temperature.

Figure 4:
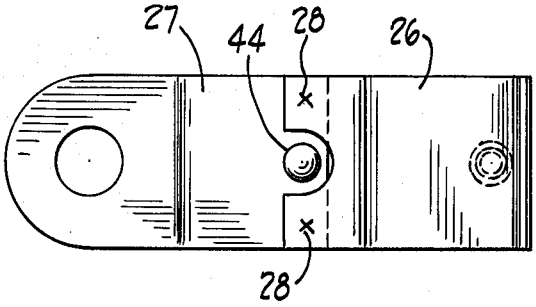
FIG. 4 is a plan view of the temperature responsive means before assembly into the thermostatic switch.

The temperature responsive means 26 is shown better in FIG. 4 prior to assembly in the stack 17 and the bimetallic blade 26 is a part of a composite structure including a spring blade 27 with one end thereof actually mounted in the stack 17 and the bimetallic blade secured by rivets or spot welding 28 to an intermediate portion of the spring blade 27. The outboard end 29 of the blade 27 provides a positive off feature and contains a positive-off screw 30 in this preferred embodiment.

First, second, and third contacts 31, 32, and 33, respectively, are fixedly mounted on the first, second, and third blades 21, 22, and 23, respectively. The second contact 32 is a duplex contact having portions 32A and 32B on opposite sides of the flexible blade or blade means 22. The first and second contacts form a first set of contacts for mutual cooperation and the second and third contacts 32B and 33 form a second set of contacts for mutual cooperation. The base 16 and the blades 21, 22, and 23 as well as the bimetallic blade 26 are mutually parallel in the stack 17. The outboard end of the bimetallic blade 26 cooperates with the outboard end of the second blade 22. In this preferred embodiment of FIGS. 1–3 this cooperation is effected by an insulator pin 35, such as a ceramic pin fixedly held on the outer end of bimetallic blade 26. This insulator pin 35 extends through an aperture 37 in the third blade 23 in order to effect cooperation between the blade 22 and the bimetallic blade 26. The blades 21 and 23 are electrically conducting, for example, are made of metal. The flexible second blade 22 may also be made of metal, but this is not essential since it does not conduct electricity, the only function being to provide a flexible support for the second contacts 32A and 32B and the contacts 32A and 32B are in electrically conductive relationship.

The mounting of terminal 24 adjacent the first blade 21 and the mounting of terminal 25 adjacent the third blade 23 in the stack 17 establishes a conductive means forming a series electrical circuit from the terminal 24 through the first and second sets of contacts to the terminal 25.

Adjusting means is provided to adjust the operating temperature of actuation of one of the sets of contacts. In this preferred embodiment the set of contacts being actuated is the second set which includes contacts 32B and 33. This adjusting means is shown as a nut 40 fixed on the base 16 and an adjusting screw 41. The lower end of the adjusting screw 41 has an insulator extension 43 such as a ceramic pin which passes through apertures in each of the blades 21, 22, and 23 and engaged an embossed abutment 44 on the spring blade 27. This provides generally a point contact for a low-friction adjustment of the position of this spring blade 27; and, hence, the position of the outer end of the bimetallic blade 26. Through the medium of the insulator pin 35, this adjusts the position at which the contacts 32 and 33 are actuated to establish different operating temperature settings.

The adjusting screw 41 carries a lug 45 which may engage either side of an upstanding lug 46 on the nut 40 to provide two arcuate limits to the adjustment movement of the adjusting screw 39. Assuming that the thermostatic switch 15 is going to be used in an electrical heating appliance, then the high expansion side of the bimetal 26 will be on the lower side thereof. Accordingly, when the lug 45 engages the stop lug 46 in the arcuate limit position establishing the lowest temperature setting, the positive-off screw 30 may be adjusted to provide a positive separation of the contacts 32 and 33 at room temperature in order to provide a positive-off and prevention of energization of the electrical applicance even though the temperature may drop below normal room temperature.

An attitude responsive means 48 is provided in the thermostatic switch 15. In the FIGS. 1–3 this attitude responsive means includes a tilt responsive pendulum 49 which is mounted relative to the third blade 23. In FIGS. 2 and 3 it is shown as being swingably or pivotally mounted on an L-shaped extension 52 of the third blade 23 by a pivot 50. The pendulum 49 is formed of a weight 53 and an insulator leg 54, the upper end of which is pivoted at the pivot 50, and is shaped as a cam 55 having a cam null or notch 56. The cam notch may be at any desired peripheral position on cam 55, according to whether a normally open or normally closed switch is desired, and, according to the attitude of mounting on the appliance. In the position shown in FIGS. 2 and 3 with the thermostatic switch 13 in its normal or upright position. This cam notch 56 cooperates with an embossed dimple or abutment 57 on the first contact blade 21. This dimple 57 acts as a cam follower.

The thermostatic switch 15 may be mounted on an electrical appliance 60 for control thereof, such as shown in U.S. Pat. No. 3,201,548. Such electrical appliance might be a room heater which has a motor driven fan blowing air across an electrical heater element and a thermostatic switch controls electrical energy to the motor and heater in parallel, or at least to the heater. Small room heaters are relatively small and light, typically made of sheet metal. They may not have particularly stable bases, and they are subject to being tipped over. Upon being tipped over, the pendulum 49 could move to the dotted line position 54A shown in FIG. 3; and, hence, the cam 55 would cooperate with the cam follower 57 to positively separate the contact 31 and 32 regardless of any adjustment position of the adjusting screw 41. This would de-energize the motor and heater or at least the electrical heater so that danger of a fire is eliminated. The thermostatic switch 15 may be mounted in any desired manner to the electrical appliance 60. For example, by the nut 40 as in U.S. Pat. No. 3,201,548, by the base 16, or as shown in FIG. 2 by a mounting nut 62 and bolt 61, passed through the hollow rivet 18 to secure the switch 15 to a bracket 63 on the appliance 60.

OPERATION

The thermostatic switch 15 will be connected at the terminals 24 and 25 to control an electrical appliance 60. The construction of the thermostatic switch 15 has many advantages. One of these is a positive off feature provided by the positive-off screw 30. This is a safety feature which establishes that the switch is definitely in the off condition regardless of how cold the ambient temperature may go below normal room temperature. The positive-off screw 30 may not be needed, and, instead, the outboard end 29 of the spring blade 27 may be bent upwardly to engage the outer end of the bimetallic blade 26 to achieve this positive-off feature. The high expansion side of the bimetallic blade 23 is on the lower side as viewed in FIG. 2 so that the blade 23 warps upwardly upon increase of temperature. The high expansion side could also be on the top, for a contact close on temperature rise.

For a room heater application the high expansion side of the bimetallic blade 26 would be on the lower side In FIGS. 1 and 2 the thermostatic switch 15 is shown in the off position established by the aforementioned positive-off feature. When the adjusting screw 41 is rotated counterclockwise away from the lug 46, the screw will move from the off region to a variable operating temperature region. The threads on the screw 39 could be righthand threads, but are shown as lefthand threads so that the spring blade 27 is moved downwardly, as viewed in FIG. 2. This permits the contacts 32B and 33 to close. The flexible blades 21 and 22 are preferably resilient blades and are biased downwardly slightly by their mounting in the stack 17. This means that not only the contacts 33 and 32B will close, but also the contacts 31 and 32A will remain closed too pass electric current to the electrical heater appliance 60. Assuming it is a motor driven fan blowing warm air from the heater across the bimetallic blade 26, the blade will warp upwardly and open the contacts 32B and 33 when the operating temperature is reached. The thermostatic switch 15 will thus cycle on and off to maintain the selected operating temperature.

Should the heater 60 be tipped over, the attitude responsive means 48, namely, the pendulum 49, will act through the cam 55 and cam follower 57 to positively move the first flexible blade 21 upwardly and hence to positively move the contact 31 out of engagement with the contact 32 for any and all adjustment positions of the screw 41. Accordingly, for normal operation the lower contact set 32B–33 will be the thermally operated contacts, and the upper contact set 31–32A will be the tilt responsive contacts.

The present invention provides a safety feature of standby contacts. One of the responsive means actuates a set of contacts for normal actuation and also is positioned to actuate on a standby basis the contacts of the other set of contacts in the event that the first contact set fails to be actuated. In the embodiment of FIGS. 1–3 the lower contact set 32B–33 are the thermal contacts yet they are also the standby tilt contacts. By this is meant that should the upper set of contacts 31–32A fail to be actuated as a tilt set of contacts, then the lower contact set 32B–33 will be so actuated by the attitude responsive means 48. There may be any number of situations arise during the life of the appliance 60 which could theoretically cause a malfunction. Suppose, for example, that a small lightweight electric room heater 60 were positioned so that it could be knocked over by moving draperies or a moving door. If the heater merely is knocked over through a 90° arc, then the pendulum 49 will be actuated to open the tilt contact set 31–32A. Suppose, however, that the room heater 60 falls only about 30° and then leans against a piece of furniture and this 30° position is just sufficient to draw a small arc at the first contact set 31–32A. This arc, burning for a short time could possibly weld together the first contact set 31–32A. Then when the appliance would fall completely over on its face, this could be a fire hazard if the electrical current were not interrupted. The present invention provides the safety feature that if the first contact set 31–32A is welded together and hence cannot open the circuit, then the action of the pendulum 49 will move both contact blades 21 and 22 away from the blade 23 and hence the second contact set 32B–33 will be actuated as standby contacts to an open condition, thus averting the dangerous condition which might start a fire.

If the lower contact set 32B–33 weld together due to repeated thermal cycling, the pendulum 49 will actuate the upper contact set 31–32A if the appliance 60 should fall over. This provides a standby set of contacts for safety.

Figure 5:
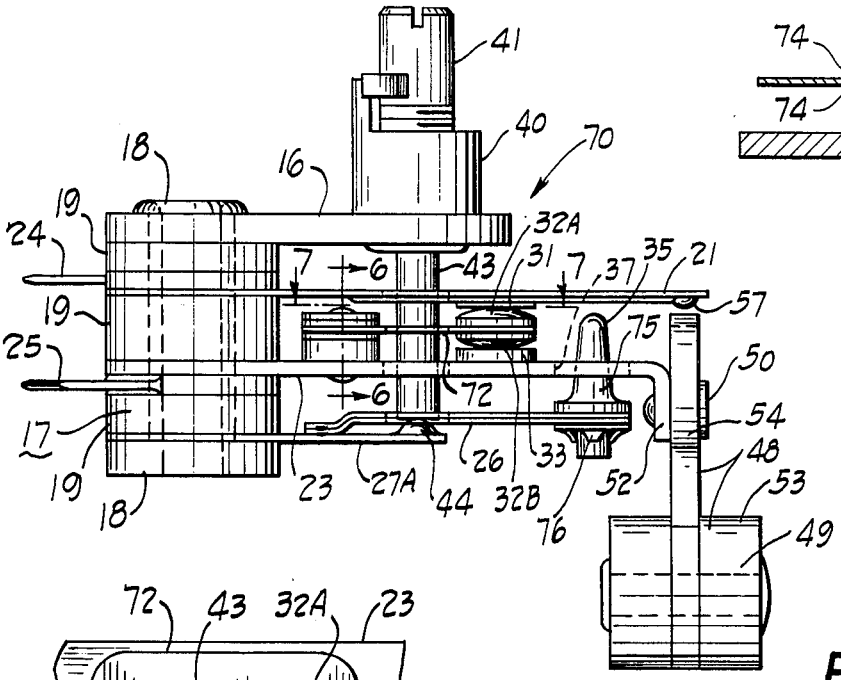
FIG. 5 is a side elevational view of a modification.
Figure 6:
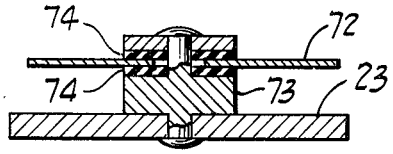
FIG. 6 is an enlarged sectional view on line 6—6 of FIG. 5.
Figure 7:
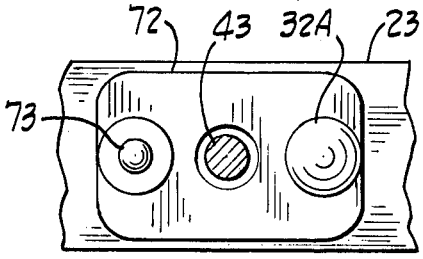
FIG. 7 is an enlarged sectional view on line 7—7 of FIG. 5.

FIGS. 5, 6, and 7 show another thermostatic switch 70 as another preferred embodiment of the invention. Many of the parts are the same as and have the same reference numerals as in the switch 15 of FIGS. 1–3. The first and third contacts 31 and 33 are mounted on the first and third blades 21 and 23, as before. The second contacts 32A and 32B are mounted on a shortened second flexible blade 72 which in turn is mounted by a rivet 73 and insulation 74 from the rigid blade 23. Again, the flexible blade 72 is perferably made of metal for convenience, yet it need not be since this blade does not conduct electrical current except possibly in the interconnection between the contacts 32A and 32B. Also, the second flexible blade 72 does not have much transverse movement so it need not be long, and hence, need not be mounted in the stack 17.

The spring blade 27A is shortened and is only long enough to be actuated by the insulator extension 43. The bimetallic blade 26 acts on the first flexible blade 21 in this embodiment by means of an insulator 75 held on by a spring washer 76. The insulator 75 extends through an aperture in the rigid blade 23 in order to cooperate with the first blade 21. The attitude responsive means 48 coacts with the first blade 21 as before.

OPERATION

In this embodiment of FIGS. 5–7 the temperature responsive means 26 and the attitude responsive means 48 both work on the same set of contacts 31–32A during normal operation. Thus, the first set of contacts 31–32A are both thermal and tilt actuated; and the second set of contacts 32B–33 are standby contacts for both thermal and tilt actuation. During normal temperature cycling the bimetal blade 26 warps upwardly and downwardly and the insulator 75 moves the first flexible blade 21 upwardly and downwardly, thus opening and closing contact 31 relative to contact 32A. Also, should the electrical appliance 60 be tipped over, the pendulum 49 would act through the cam 55 and cam follower 57 to move the contact 31 relative to the contact 32A. However, in the event of welding together of the first contact set, the standby set of contacts will come into operation. This accidental welding together of the contacts might be as described above or it might happen because during many years of use, the contacts will develop pits and spikes during the tens of thousands of cycles, and these pits and spikes could become progressively worse to draw increasingly larger arcs which arcs could eventually weld together the contacts. No matter how such upper set of contacts 31–32A might become welded together, the second set of contacts 32B–33 will come into operation as a standby set of contacts The bimetallic blade 26 will, upon heating, move upwardly to move upwardly the first blade 21 and through the welding together of the contacts would also move upwardly the second blade 22. Thus, the separation of the contacts in the electrical circuit will occur between the contact 32B and contact 33, although at a slightly higher operating temperature because of the greater work required from the bimetallic blade 26. This same separation of the contacts 32B and 33 would occur by action of the pendulum 49 should the appliance 60 be tipped over. The force developed by the pendulum 49 is sufficient to move both blades 21 and 72 so that the circuit is opened at the second set of contacts 32B and 33.

Figure 8:
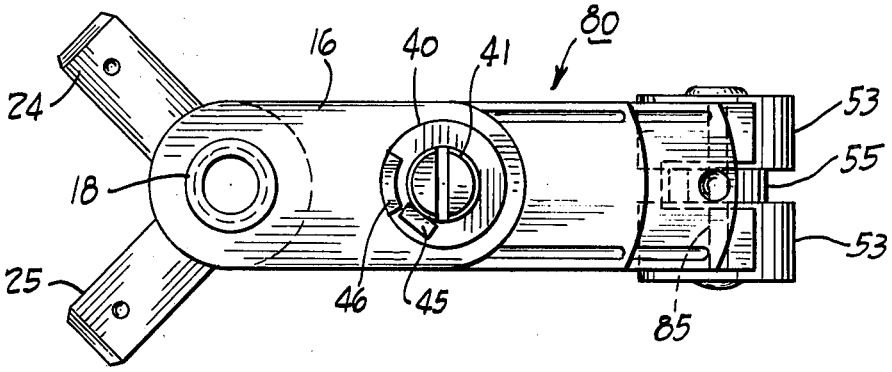
FIGS. 8 and 9 are plan and elevational views, respectively, of a modification.
Figure 9:
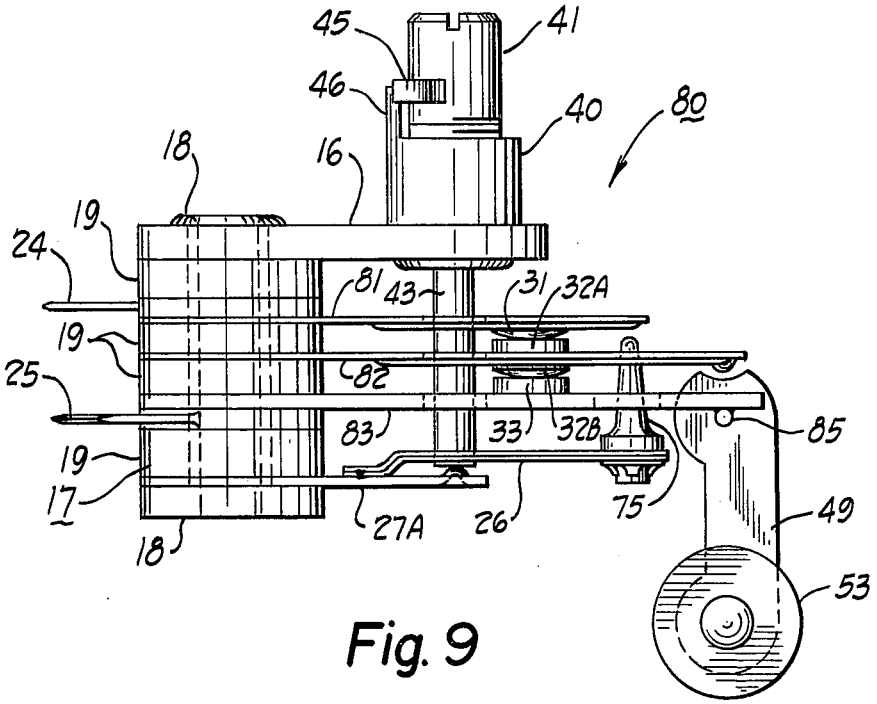

FIGS. 8 and 9 show another preferred embodiment of a thermostatic switch 80 having first and second flexible blades 81 and 82, respectively. These blades carry the first and second contacts 31 and 32A. The bimetallic blade 26 actuates the first contact blade 81, as in FIG. 5, through the medium of the insulator 75. The pendulum 49 in this case is mounted on an axle 85 which is welded to the underside of the rigid blade 83 so that the pendulum swings in the plane of the paper of FIG. 9. This is merely to illustrate a different form of mounting of the pendulum 49 to show that the pendulum may either swing as in FIG. 9 or as in FIGS. 1–7.

OPERATION

The normal thermal cycling contacts are the first set of contacts 31–32A and the normal tilt operated contacts are the second set of contacts 32B and 33. The thermostatic switch 80 provides a standby set of contacts for one of the responsive means in the event that one of the normal set of contacts fails to operate. The standby contacts in this case of thermostatic switch 80 is the lower set of contacts 32B–33 and these are standby thermal contacts. In the event of welding together of the contacts 31 and 32A, then when the bimetallic blade 26 attempts to open these contacts, both blades 81 and 82 will be moved upwardly by this bimetallic blade to cause thermal cycling at the second set of contacts 32B–33. This, again, would be at a slightly higher operating temperature because of the greater work required by the bimetallic blade 26.

Figure 10:
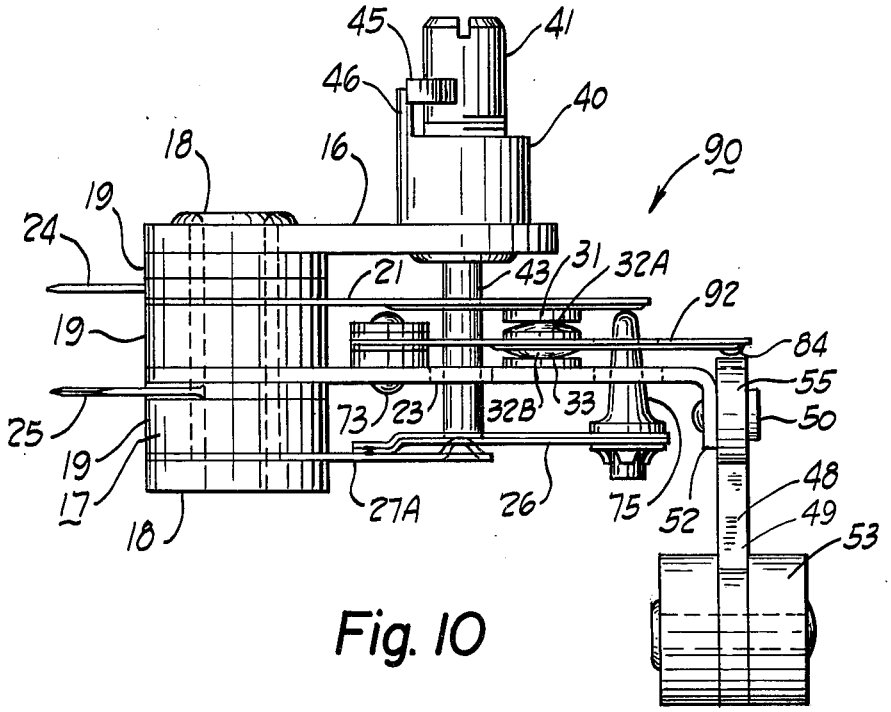
FIGS. 10, 11 and 12 are side elevational views of three further modifications.

FIG. 10 shows another preferred embodiment of a thermostatic switch 90 which has many parts similar to the switch 80 of FIG. 9. Differences include mounting the pendulum 49 as shown in FIG. 1 and include a second flexible blade 92 which is mounted in a insulated manner to the third rigid blade 23. In the construction shown in FIG. 10 the bimetallic blade 26 actuates the first flexible blade 21 for normal thermal cycling of the first set of contacts 31–32A, and the attitude responsive means 48 provides normal tilt actuation of the second set of contacts 32B–33. This is accomplished by the second flexible blade 92 being longer and carrying the cam follower 84 for actuation by the cam 55. Again, in the thermostatic switch 90 of FIG. 10 one of the responsive means provides normal actuation of one set of contacts and standby actuation of another set of contacts. In this switch 90 the upper set of contacts 31–32A are the thermal cycling contacts and the lower set of contacts 32B–33 are the tilt switch contacts and also are standby thermal cycling contacts. Should the upper set of contacts 31– 32A become welded together or inoperative for some reason then as the bimetallic blade 26 moved upwardly, it would move upwardly both the first flexible blade 21 and the second flexible blade 92 to cause opening of the second set of contacts 32B–33 on a standby basis.

Figure 11:
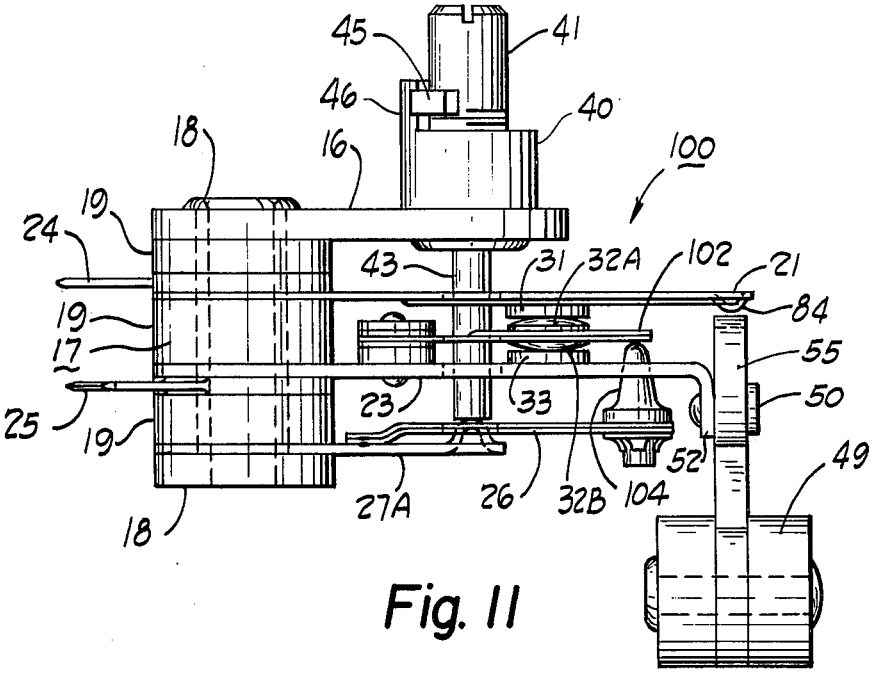

FIG. 11 shows another preferred embodiment of a thermostatic switch 100. The attitude responsive means shows a pendulum which may swing transversely as in FIGS. 1–3, but which may also be modified to swing longitudinally as in FIG. 9. The thermostatic switch 100 has the first flexible blade 21 actuated by the pendelum 49 and has a shortened second flexible blade 102 which carries the second contacts 32A and 32B and which is actuated by an insulator 104 carried on the bimetallic blade 26. The second flexible blade 102 is mounted in an insulated manner on the third rigid blade 23. In a manner similar to the switch 15 of FIGS. 1–3, the upper set of contacts 31–32A are normally operated tilt switch contacts and the lower set of contacts 32B–33 are normally thermally cycling contacts but are also standby tilt switch contacts. The standby feature comes into use if the upper set of contacts 31–32B become inoperative in which case actuation by the pendulum 49 would move upwardly both the first flexible blade 21 and the second flexible blade 102 to open the circuit at the second set of contacts 32B–33.

Figure 12:
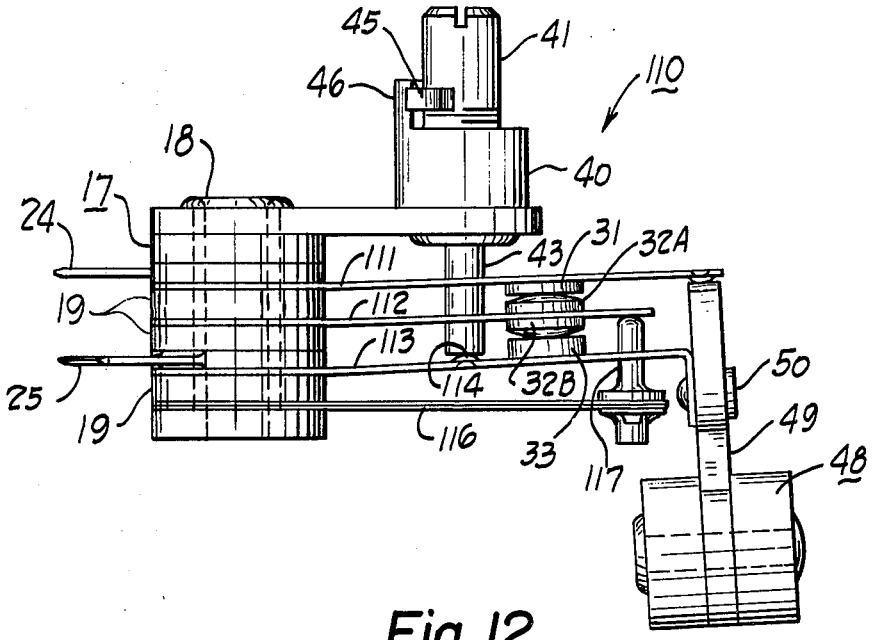

FIG. 12 illustrates another preferred embodiment of a thermostatic switch 110 in which the first, second, and third flexible blades, 111, 112, and 113, respectively, carry the first, second, and third contacts, 31, 32, and 33, respectively. The insulator extension 43 extends through apertures in the first and second blades 111 and 112 and coacts with an embossed dimple 114 on the third flexible blade 113. This third blade 113 carries the attitude responsive means 48 which again is the pendulum 49 mounted on the pivot 50 on the outer end of this third blade 113. A bimetallic blade 116 is carried in the stack 17 as a temperature responsive means and the outer end of this bimetallic blade acts through an insulator 117 through an aperture in the outer end of the flexible blade 113 to cooperate with the outer end of the flexible blade 112. The flexible blade 113 is resilient and is biased upwardly by its mounting in the stack 17. Also, this flexible blade 113 is slightly stiffer than the second flexible blade 112 in order to carry the weight of the pendulum 49 and also to resist the slight downward bias of the second flexible blade 112 and the slight downward bias of the first flexible blade 111. This mounting of the blades assures that the contacts 31, 32 and 33 are normally in engagement for a closed series circuit between the two terminals 24 and 25. Upon thermal cycling, the bimetallic blade 116 normally actuates the lower set of contacts 32B–33 and the upper set of contacts 32–32A are tilt switch contacts. The lower set of contacts 32B–33 are standby tilt switch contacts in the event that the first set of contacts 31–32A become welded together.

The many preferred embodiments of the invention show two different responsive means, one being temperature responsive and the other being attitude responsive. Each of the many embodiments show that the temperature responsive means actuates a set of contacts, and the attitude responsive means also actuates a set of contacts. One of the responsive means is mounted so that it actuates a first set of contacts in a normal manner, yet can actuate a second set of contacts in a standby manner should the first set of contacts fail to be actuated for some reason. This is a safety feature which can help prevent many fires, especially after years of operation of the electrical appliance 60 when the surface of the contacts may be in less than perfect condition.

The various embodiments of the invention show that two adjacent contacts 32A and 32B are mounted so as to be movable. Also they are on opposite sides of the flexible second blade 22, so that as one moves toward closing of the respective contact set, the other moves toward opening of the respective contact set. This helps establish the safety feature of the set of contacts provided for standby operation.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A thermostatic switch comprising, in combination,
a base,
at least first, second, and third contacts,
said first and second contacts constituting a first set of contacts,
said third contact and another contact constituting a second set of contacts,
at least first and second electrical terminals,
conductive means forming a series electrical circuit from said first terminal through said first and second sets of contacts to said second terminal,
temperature responsive means movable with changes of temperature,
attitude responsive means movable with changes of attitude relative to said switch,
first mounting means mounting on said switch one of said responsive means relative to the contact sets to relatively actuate the contacts of one of said sets of contacts,
and second mounting means mounting on said switch the other of said responsive means relative to the contact sets to relatively actuate the contacts of said first contact set to an open condition and to relatively actuate on a standby basis the contacts of said second contact set in a direction toward an open condition upon failure of said first contact set to be actuated to an open condition, the opening of either contact set opening the series electrical circuit in the switch.

2. A thermostatic switch as set forth in claim 1, including, adjustment means on said switch connected to adjust the temperature of actuation of one of said contact sets.

3. A thermostatic switch as set forth in claim 2, wherein said adjustment means adjusts the position of the actuating end of said temperature responsive means.

4. A thermostatic switch as set forth in claim 1, including,
flexible blade means mounted on said switch as part of said mounting means,
and mounting one of said contacts on said flexible blade means for movement therewith.

5. A thermostatic switch as set forth in claim 4, wherein said second contact is mounted on said flexible blade means,
said second contact being included in each of said contact sets.

6. A thermostatic switch as set forth in claim 5, wherein said second contact is a duplex contact having two different portions electrically interconnected with one portion being in said first contact set and said second portion being in said second contact set.

7. A thermostatic switch as set forth in claim 6, wherein said two portions of said second contact are on opposite sides of said flexible blade means so that as said first portion moves toward closing of said first contact set, said second portion moves toward opening of said second contact set.

8. A thermostatic switch as set forth in claim 1, including, said mounting means mounting two adjacent ones of said contacts to be movable.

9. A thermostatic switch as set forth in claim 1, including, first, second, and third blade means,
a stack on said switch,
said mounting means mounting an end of said first and third blade means in said stack,
and said mounting means mounting said first, second, and third contacts on said first, second, and third blade means.

10. A thermostatic switch as set forth in claim 9, including, said first and second blade means being flexible to establish said first and second contacts being movable.

11. A thermostatic switch as set forth in claim 10, wherein said attitude responsive means is a gravity-actuated pendulum swingably mounted on said third blade means.

12. A thermostatic switch as set forth in claim 9, wherein said third blade means is relatively rigid for a relatively fixed position of said third contact.

13. A thermostatic switch as set forth in claim 11, wherein said mounting means mounts said pendulum to coact wth said first blade means.

14. A thermostatic switch as set forth in claim 13, wherein said mounting means mounts said temperature responsive means to coact with said second blade means.

15. A thermostatic switch as set forth in claim 13, wherein said mounting means mounts said temperature responsive means to coact with said first blade means.

16. A thermostatic switch as set forth in claim 1, including, first and second flexible blades,
a stack mounted on said base,
said mounting means including mounting one end of said blades in said stack,
said mounting means also including mounting said first and second contacts on movable parts of said first and second flexible blades, respectively.

17. A thermostatic switch as set forth in claim 16, wherein said mounting means establishes that said temperature responsive means actuates one of said blades and said attitude responsive means actuates the other of said blades.

18. A thermostatic switch as set forth in claim 10, wherein said mounting means insulatedly mounts said second blade means on an intermediate portion of said third blade means,
said third blade means being relatively rigid for a substantially fixed position of said third contact.

19. A thermostatic switch as set forth in claim 10, wherein said attitude responsive means is mounted to actuate said first contact and said temperature responsive means is mounted to actuate said second contact.

20. A thermostatic switch as set forth in claim 19, wherein said mounting means mounts said second blade means in said stack.

21. A thermostatic switch as set forth in claim 19, wherein said mounting means mounts said second blade means on said third blade means and insulated therefrom.

22. A thermostatic switch as set forth in claim 10, wherein said mounting means mounts said attitude responsive means to coact with said second blade means and said mounting means mounts said temperature responsive means to coact with said first blade means.

23. A thermostatic switch as set forth in claim 22, wherein said mounting means mounts said second blade means in said stack.

24. A thermostatic switch as set forth in claim 22, wherein said mounting means mounts said second blade means on said third blade means and insulated therefrom.

25. A thermostatic switch as set forth in claim 10, wherein said mounting means mounts each of said responsive means to coact with said first blade means.

26. A thermostatic switch as set forth in claim 10, wherein said third blade means is flexible to establish a relatively movable third contact.

27. A thermostatic switch as set forth in claim 26, wherein said attitude responsive means is a gravity-actuated pendulum pivotally mounted on said flexible third blade means and having a cam thereon coacting with one of said first and second blade means.

28. A thermostatic switch as set forth in claim 26, including adjustment means on said switch connected to adjust the position of said flexible third blade means.

29. A thermoplastic switch as set forth in claim 10, wherein said temperature means is a bimetallic member, and an insulator acting between said bimetallic member and one of said first and second blade means.

30. A thermostatic switch as set forth in claim 1, wherein said temperature responsive means is a composite of a spring blade and a bimetallic blade connected in series.

31. A thermostatic switch as set forth in claim 30, including an extension on said spring blade extending beyond the connection point of said bimetallic blade and said spring blade, and an abutment acting between said bimetallic blade and said spring blade extension to act as a positive off means for said contacts.

* * * * *

UNITED STATES PATENT AND TRADEMARK OFFICE

CERTIFICATE OF CORRECTION

PATENT NO. : 3,964,004

DATED : June 15, 1976

INVENTOR(S) : Charles S. Mertler

It is certified that error appears in the above-identified patent and that said Letters Patent are hereby corrected as shown below:

Claim 29, line 1, the word "thermoplastic" should read --thermostatic--.

Signed and Sealed this

Twelfth Day of October 1976

[SEAL]

*Attest:*

RUTH C. MASON
*Attesting Officer*

C. MARSHALL DANN
*Commissioner of Patents and Trademarks*